US008696078B2

(12) United States Patent
Gasser

(10) Patent No.: US 8,696,078 B2
(45) Date of Patent: Apr. 15, 2014

(54) COUPLING DEVICE FOR DRAWERS

(71) Applicant: Julius Blum GmbH, Hochst (AT)

(72) Inventor: Ingo Gasser, Hochst (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/899,931

(22) Filed: May 22, 2013

(65) Prior Publication Data

US 2013/0249366 A1 Sep. 26, 2013

Related U.S. Application Data

(63) Continuation of application No. PCT/AT2011/000383, filed on Sep. 20, 2011.

(30) Foreign Application Priority Data

Nov. 23, 2010 (AT) ..... A 1940/2010

(51) Int. Cl.
*A47B 88/00* (2006.01)

(52) U.S. Cl.
USPC ..... 312/348.2; 312/334.5

(58) Field of Classification Search
USPC ..... 312/348.1, 348.2, 348.3, 330.1, 334.6, 312/265.5, 265.6, 263, 348.4; 403/331, 403/322.4, 325, 326
See application file for complete search history.

(56) References Cited

U.S. PATENT DOCUMENTS 5,261,737 A * 11/1993 Faust et al. ..... 312/334.46
5,281,021 A 1/1994 Röck et al.
5,439,284 A * 8/1995 Grabher ..... 312/334.6
5,588,729 A * 12/1996 Berger ..... 312/334.4
5,632,541 A * 5/1997 Uthoff ..... 312/333
5,971,516 A * 10/1999 Huber ..... 312/348.1
6,913,334 B2 7/2005 Weichelt
2002/0158557 A1 10/2002 Weichelt (Continued)

FOREIGN PATENT DOCUMENTS

DE 4103045 * 2/1991
DE 20 2005 005 489 6/2005

(Continued)

OTHER PUBLICATIONS

International Search Report issued Feb. 15, 2012 in corresponding International (PCT) Application No. PCT/AT2011/000383.

(Continued)

*Primary Examiner* — Janet M Wilkens
(74) *Attorney, Agent, or Firm* — Wenderoth, Lind & Ponack, L.L.P.

(57) ABSTRACT

A device for releasably coupling a drawer to a retractable rail of a drawer retraction guide includes a locking part which can be releasably locked to releasably couple the drawer to the retractable rail of the drawer retraction guide; a handle part which is designed to be actuated by hand and allows the locking part to be released relative to the retractable rail of the drawer retraction-guide; and an opposite retaining part between which retaining part and the locking part the rail is accommodated in the mounted position. The locking part can be moved into a direction pointing away from the opposite retaining part by a hand applying pressure to the handle part, the opposite retaining part being provided with at least one resilient tongue.

20 Claims, 7 Drawing Sheets

(56) References Cited

U.S. PATENT DOCUMENTS

| | | | | |
|---|---|---|---|---|
| 2004/0095047 | A1* | 5/2004 | Salice | 312/332.1 |
| 2004/0227440 | A1 | 11/2004 | Booker et al. | |
| 2008/0218045 | A1* | 9/2008 | Moser | 312/333 |
| 2009/0261700 | A1* | 10/2009 | Chen et al. | 312/334.46 |
| 2011/0068670 | A1 | 3/2011 | Ritter | |

FOREIGN PATENT DOCUMENTS

| | | | |
|---|---|---|---|
| DE | 20 2005 018 788 | | 5/2007 |
| DE | 202009013706 | * | 5/2011 |
| EP | 0 421 458 | | 4/1991 |
| EP | 1 285 604 | | 2/2003 |
| WO | 2007062961 | | 6/2007 |
| WO | 2009/149479 | | 12/2009 |
| WO | 2010/040273 | | 4/2010 |

OTHER PUBLICATIONS

Austrian Search Report issued Jul. 12, 2011 in corresponding Austrian Patent Application No. A 1940/2010.

* cited by examiner

COUPLING DEVICE FOR DRAWERS

BACKGROUND OF THE INVENTION

The present invention concerns a device for releasably coupling a drawer to an extendable rail of a drawer extension guide, including a latching portion which can be releasably arrested for releasably coupling the drawer to the extendable rail of the drawer extension guide, a handle portion which is adapted for hand actuation and by which the latching portion is releasable relative to the rail of the drawer extension guide, and a counterpart holding portion. The rail is accommodated in the mounted position between the counterpart holding portion and the latching portion. The latching portion is movable by hand pressure on the handle portion in a direction facing away from the counterpart holding portion.

In addition, the invention concerns a drawer extension guide comprising a device of the kind to be described, as well as a drawer which is to be connected by way of such a device to en extendable rail of a drawer extension guide.

According to the state of the art, coupling devices are known by which a drawer can be fitted or removed in its entirety on an extendable rail of a drawer extension guide so that the drawer can be completely released from the drawer extension guide—for example for cleaning purposes—and can subsequently be fixed in position again. Coupling of the drawer to the extension guide can be effected automatically by a resilient latching portion of the device coming into latching engagement with a predetermined connecting location on the extension rail. In the mounting procedure, the drawer extension guide is firstly pre-mounted to the article of furniture, whereupon the drawer to be fixed in position is pushed onto the extension rail which is in the closed position until automatic latching of the drawer to the extension rail occurs by way of the latching portion. Dismantling of the drawer relative to the extension rail can also be effected without the use of a tool by a handle portion adapted for hand actuation being actuated, whereby the latching portion is released from the latching engagement and the drawer can then be removed.

Such coupling devices for drawers are described in EP 0 421 458 B1 and in WO 2009/149479 A1 to the present applicant. In that case, latching is effected by latching portions whose displaced abutment surfaces are successively latchingly engaged in an opening in the extension rail. Thereby, when the drawer is pushed in, bring about gradual latching engagement with a steady reduction in the play between the drawer and the extension rail.

DE 20 2005 005 489 U1 describes a drawer extension guide having a runner rail, at the front end of which is arranged an insertion limiter having a shaped spring. That provides that the runner rail can be displaced in the insertion direction only until a front end of the shaped spring bears against the central rail of the drawer extension guide. The latching nose of a coupling device engages into a provided recess in the rail, and the shaped spring is moved out of the path of displacement of the central rail. That ensures that the runner rail is reliably coupled to the displaceable furniture part.

WO 2010/040273 discloses a device for releasably coupling a drawer to a drawer extension guide, wherein a hook portion can be latchingly engaged on corresponding limbs of the extension rail. By applying manual pressure to an elastic portion, the hook portion can be removed from its latching engagement with the limbs whereby the drawer can be separated from the extension rail.

In regard to the latching engagement between the drawer and the extension rail, it is desirable if, upon mounting of the drawer box, an extension rail assumes a more or less predetermined position relative to the latching portion so that the latching portion can be properly latched to the predetermined connecting location on the extendable rail. If that position is not within a predetermined tolerance range, it would be possible for parts of the coupling device that are injection molded from plastic material, being damaged by the drawer being pushed on to the extension rail, or even entirely sheared off same.

SUMMARY OF THE INVENTION

Therefore, the object of the present invention is to propose a device of the general kind set forth in the opening part of this specification, avoiding the foregoing disadvantage.

According to the invention that is achieved by the features described below. Further advantageous configurations of the invention are also described below.

According to the invention it is therefore provided that the counterpart holding portion has at least one spring tongue.

By virtue of that spring tongue, it is possible for the drawer in the assembly procedure to be guided—in particular laterally—relative to the extendable rail of the drawer extension guide in a direction extending transversely relative to the extension direction. Therefore, in the assembly procedure, the drawer is centered by the spring tongue relative to the extension rail and that therefore brings about play compensation—in particular laterally—of the drawer relative to the extendable rail.

In a possible embodiment, the spring tongue jointly with the oppositely disposed latching portion form an introduction funnel for the front end of the extension rail, the width of the introduction funnel decreasing in the mounted position in the direction of the drawer front panel.

The spring tongue can have a preferably curved run-in incline by which the extendable rail can be pressed upon insertion into the device against the latching portion. The spring tongue and/or the latching portion can be resilient in a direction extending transversely relative to the longitudinal direction of the rail, so that any positional tolerances which occur in respect of the drawer relative to the extendable rail can be compensated. Depending on the respective installation position of the device, the spring tongue and/or the latching portion can be resilient in the horizontal or also in the vertical direction.

The drawer extension guide according to the invention has a carcass rail to be fixed to a furniture carcass, at least one extension rail mounted displaceably relative to the carcass rail, and a device of the kind in question, by which a drawer is to be releasably connected to the extension rail of the drawer extension guide.

In a structurally simple solution, the latching portion and the handle portion can be made in one piece. It is particularly desirable if the device in its entirety is made in one piece from plastic material. Such a device can therefore be easily produced in the course of an injection molding process in integral form from a thermoplastic material.

The drawer according to the invention is characterised by at least one drawer extension guide of the above-indicated kind.

BRIEF DESCRIPTION OF THE DRAWINGS

Further details and advantages of the present invention are described by means of the specific description hereinafter, and in the drawings.

DETAILED DESCRIPTION OF THE INVENTION

Figure 1:
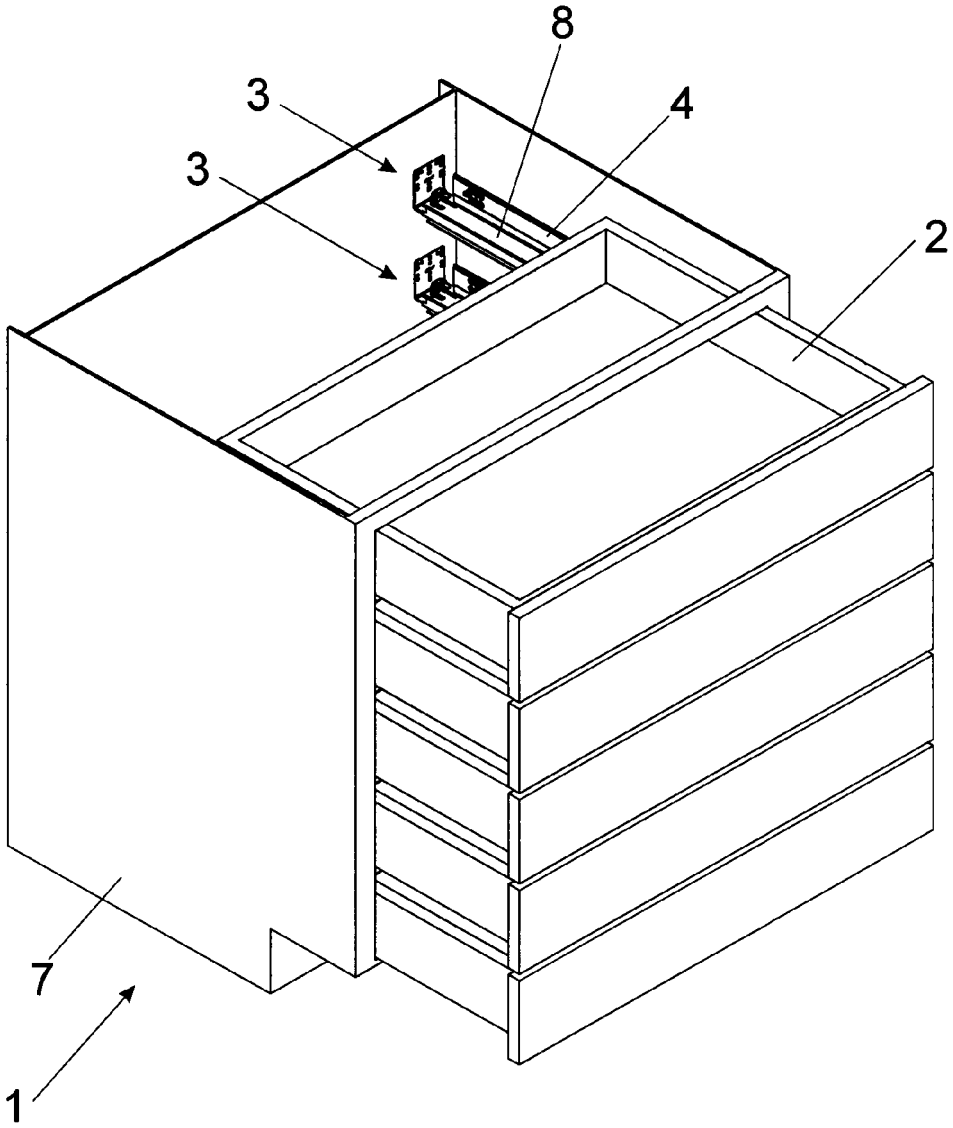
FIG. 1 is a perspective view of an article of furniture with drawers which can be fitted to and removed from a drawer extension guide in their entirety.

FIG. 1 is a perspective view of an article of furniture 1 having a plurality of drawers 2 which are supported movably relative to a furniture carcass 7 by drawer extension guides 3. The drawer extension guides 3 each include a carcass rail 4 to be fixed to the furniture carcass 7 and at least one drawer rail 8 which is extendable relative thereto. The drawers 2 can be releasably connected to the extendable rails 8 by a device still to be described. Associated with each drawer 2 are two respective drawer extension guides 3 which are pre-mounted at opposite side walls of the furniture carcass 7. The drawers 2 can be fitted to and removed from the extendable rails 8 without the use of a tool.

Figure 2:
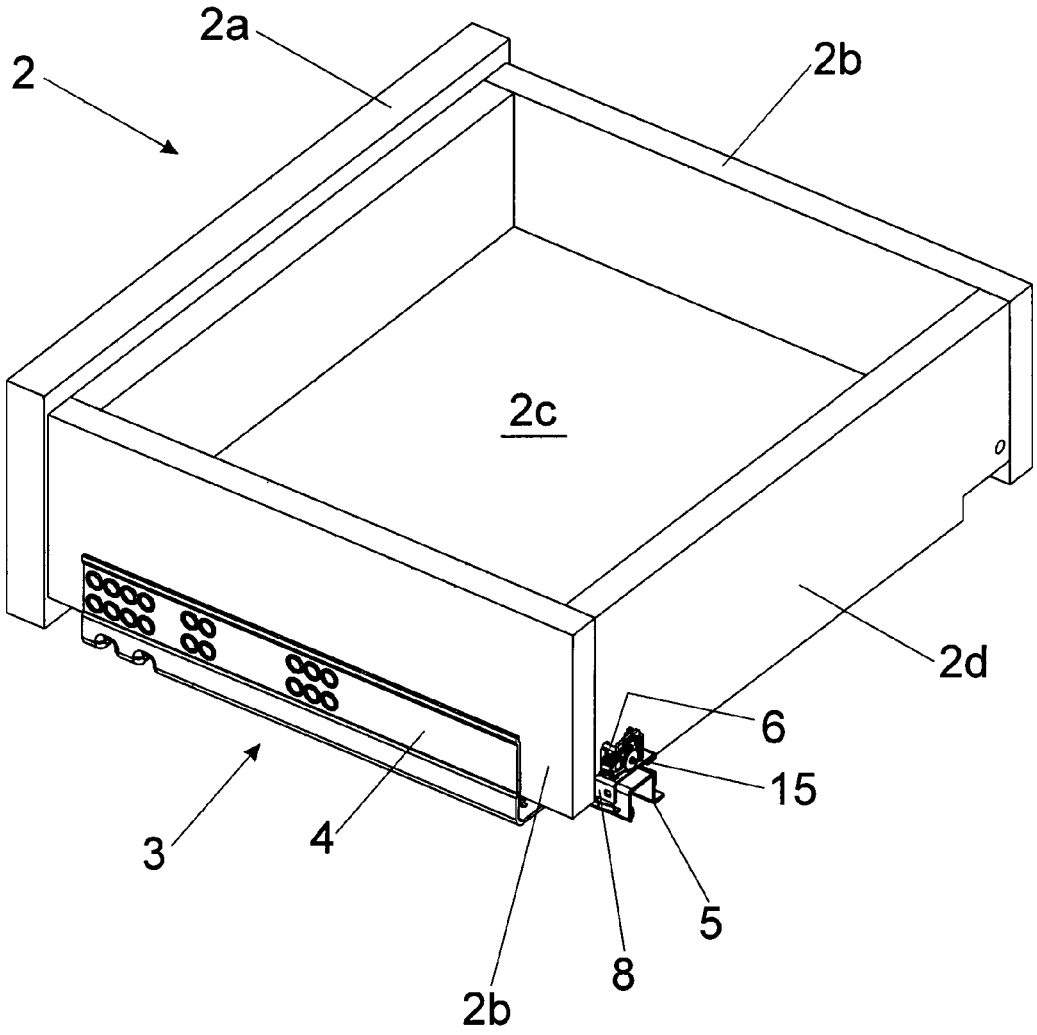
FIG. 2 is a perspective view of a drawer fixed to a drawer extension guide.

FIG. 2 shows a perspective view of a drawer 2 coupled to the drawer extension guide 3. The drawer 2 includes a front panel 2*a*, side walls 2*b*, a drawer bottom 2*c* and a drawer rear wall 2*d*. It is possible to see the stationary carcass rail 4 and the rail 8, displaceable relative thereto, of the drawer extension guide 3, and an additional displaceable central rail 5 can be arranged between the carcass rail 4 and the extendable rail 8 in order to permit full extension of the drawer 2 relative to the furniture carcass 7. Mounted at the rear end of the extendable rail 8 is an abutment with a preferably adjustable pin 6 which in the mounted condition of the drawer 2 is disposed in an opening provided for the pin 6 in the drawer rear wall 2*d*. The position of the pin 6 can be adjusted by the adjusting wheel 15 so that it is also possible in that way to adjust the position of the front panel 2*a* (and therewith the external front panel alignment). Upon assembly of the drawer 2, it is pushed onto the rail 8 which is in the closed position until the pin 6 engages into the opening provided in the drawer rear wall 2*d* and thus defines the rear end abutment of the drawer 2 relative to the rail 8. The front region of the drawer 2 is releasably coupled to the front end of the extendable rail 8 by the coupling device 9 that is still to be described.

FIGS. 3*a*-3*d* show various views of the coupling device 9 provided for releasably coupling the drawer 2 to the extendable rail 8 of the drawer extension guide 3. The coupling device 9 has a resilient latching portion 10 which can be releasably latched to a predetermined connecting location on the extendable rail 8. A handle portion 11 adapted for hand actuation is connected to the latching portion 10, and the latching portion 10 is movable in the direction of the arrow 12*b* against its resilient action by hand pressure on the handle portion 11 in the direction of the arrow 12*a* so that the latching portion 10 can be released again from the predetermined connecting location on the extendable rail 8. The latching portion 10 and the handle portion 11 can be connected to a main body 14 of the coupling device 9 by a flexural hinge 13. The coupling device 9 includes a counterpart holding portion 15 arranged opposite the latching portion 10, and the front end of the extendable rail 8 is accommodated in the mounted condition between the latching portion 10 and the counterpart holding portion 15. The counterpart holding portion 15 includes a spring tongue 16 which has a preferably curved run-in incline for the front end of the extendable rail 8 whereby it is possible to bring about lateral play compensation of the drawer 2 relative to the rail 8.

Figure 3A:
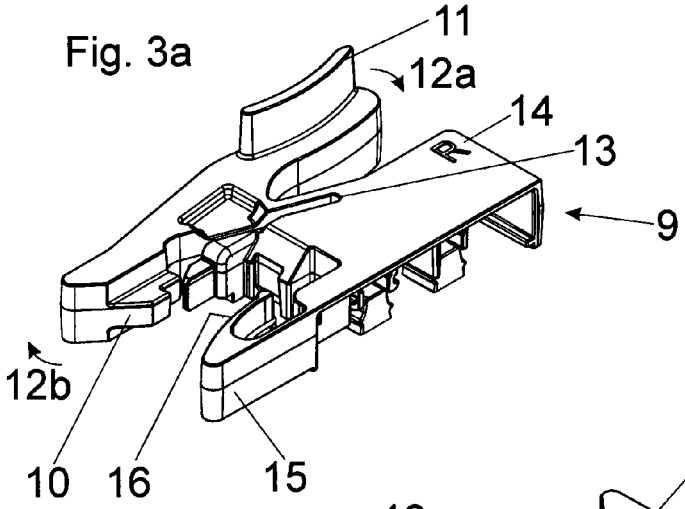
FIGS. 3*a*-3*d* show various views of a possible embodiment of a coupling device.
Figure 3B:
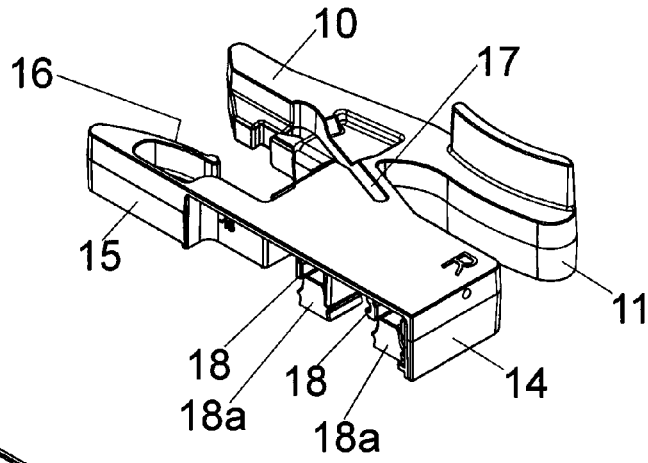

FIG. 3*b* shows a further perspective view of the device 9. In the illustrated embodiment, the coupling device 9 is injection molded in its entirety in one piece from plastic material. The spring tongue 16 of the counterpart holding portion 15 and the resilient latching portion 10 form an insertion funnel for the receiving front end of the extendable rail 8 so that the drawer 2 to be fitted can be centered relative to the extendable rail 8. So that the handle portion 11 can be moved in the direction of the arrow 12*a*, between the main body 14 and the handle portion 11 is an elongate slot 17 which allows pivotal movement of the handle portion 11 relative to the main body 14. The coupling device 9 further has injection-molded fixing dowels 18 with spreader wedges 18*a* by which the device 9 can be fixed to the drawer 2, preferably at a carrier rail pre-mounted thereto.

Figure 3C:
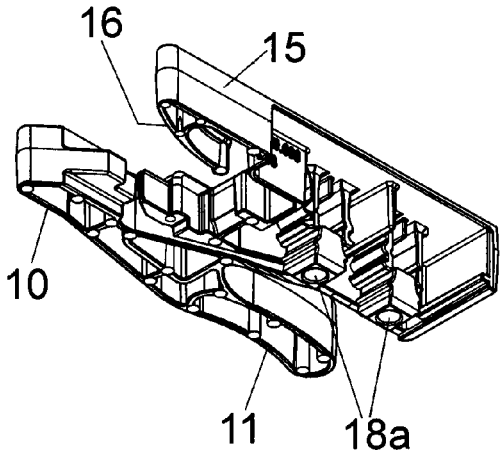

FIG. 3*c* shows a perspective view from below of the device 9. It is possible to see the injection-molded fixing dowels 18 which, in a first mounting step, are passed through an opening in a carrier rail (not shown here. In a further mounting step, spreader wedges 18*a* mounted at predetermined desired-fracture locations of the fixing dowels 18 are detached from those desired-fracture locations and are urged into the fixing dowels 18 so that the fixing dowels are expanded by the pressed-in spreader wedges 18*a* in the mounted position and arrested therewith.

Figure 3D:
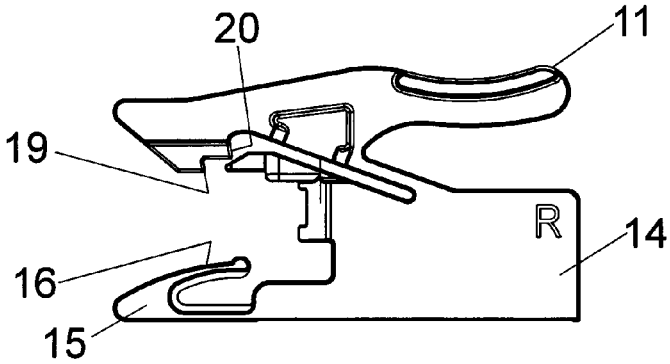

FIG. 3*d* shows a plan view of the device 9. The latching portion 10 has a catch portion 19 by which the coupling device 9 (and therewith the drawer 2) can be releasably arrested relative to the extendable rail 8 in a first depth position. That provides for pre-positioning of the coupling device 9 relative to the extendable rail 8. In addition, the latching portion 10 has at least one abutment surface 20 by which the coupling device 9 can be releasably arrested in a second depth position differing from the first depth position. In that respect, the catch portion 19 in the first depth position and the abutment surface 20 in the second depth position respectively engage into one and the same opening in the extendable rail 8. The spring tongue 16 preferably has a free end, but both ends of the spring tongue 16 can be connected to the main body 14 and the counterpart holding portion 15, respectively, forming an intermediate space.

Figure 4:
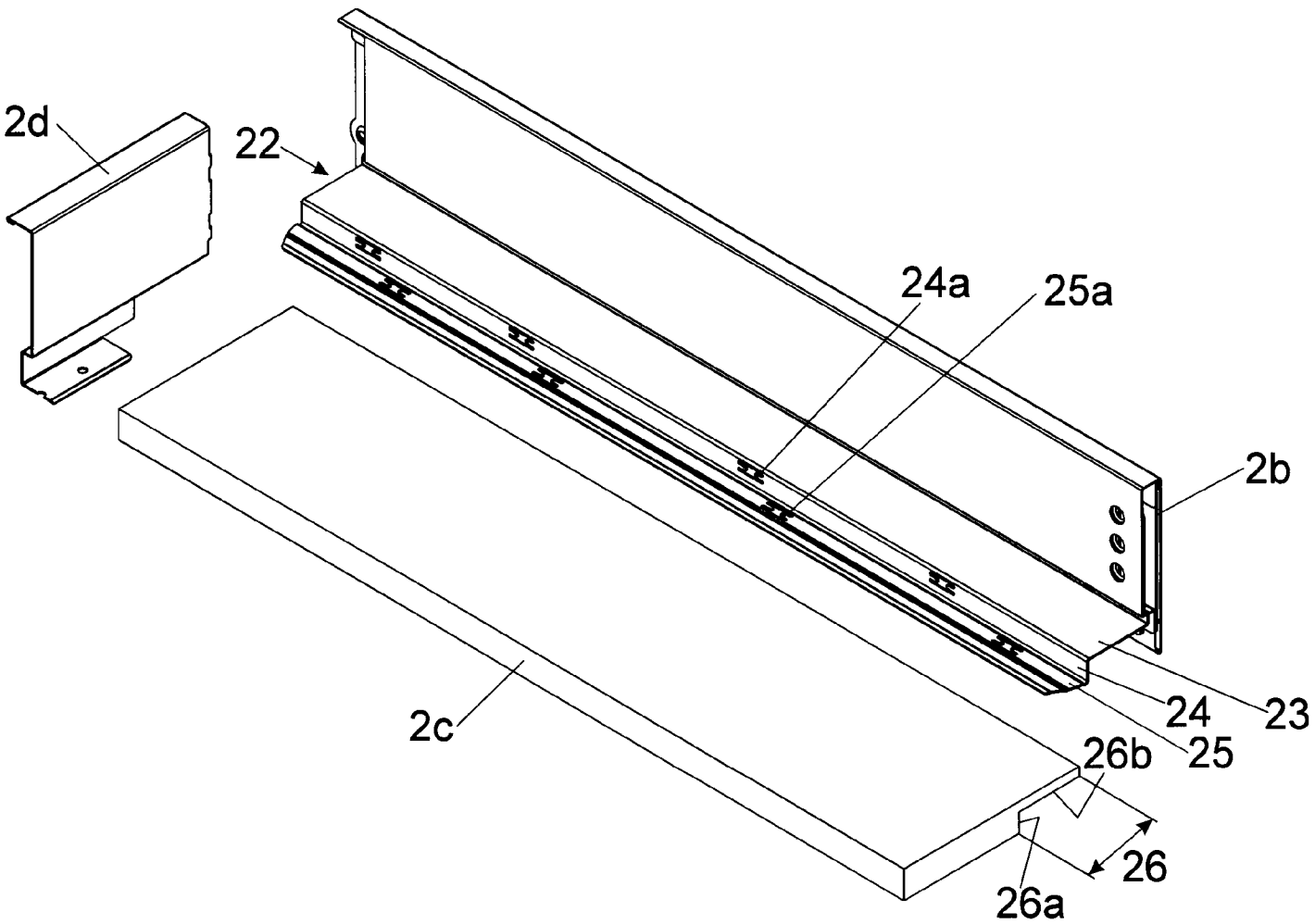
FIG. 4 is a perspective view of a drawer which can be releasably connected by a carrier rail to an extendable rail of the drawer extension guide.

FIG. 4 shows a perspective view of a carrier rail 22 connected in the mounted position to a drawer 2. It is also possible to see the drawer bottom 2*c* and the drawer rear wall 2*d*. At least one edge region of the drawer bottom 2*c* has a stepped rabbet 26, that is to say a recess which is open towards the edge of the drawer bottom 2*c*, extending substantially over the entire length of the drawer bottom 2*c*. In the mounted position, the rabbet 26 forms a vertically disposed portion 26*a* and a horizontally extending portion 26*b*. Such a configuration for the drawer bottom 2*c* means that the surface of the drawer bottom 2*c* can be placed lower and moved closer to the upper edge of the extendable rail 8 (FIG. 1). The edge region of the drawer bottom 2*c* is thus of a smaller thickness without the stability of the drawer bottom 2*c* suffering therefrom as that local weakening is compensated by the provided carrier rail 22. The carrier rail 22 has a first (lower) horizontal contact web 25 for bearing against the underside of the drawer bottom 2*c*, and an upper horizontal leg 23 for bearing against the horizontal portion 26*b* of the rabbet 26. The lower horizontal contact web 25 and the upper horizontal leg 23 are connected together by way of a preferably substantially perpendicular or curved second contact web 24. For fixing the drawer bottom 2*c* relative to the carrier rail 22, there are provided a plurality of stamped-out tabs 24*a* and 25*a* which can be respectively pressed in the direction of the drawer bottom 2*c* whereby the drawer bottom 2*c* can be fixed in force-locking relationship relative to the carrier rail 22. A drawer side wall 2*b* is connected to the carrier rail 22. It can be seen that the vertically extending contact web 24 with the horizontal leg 23 and the drawer side wall 2*b* form a U-shaped profile, and the coupling device 9 is arranged in the mounted position within that U-shaped profile of the carrier rail 22.

Figure 5A:
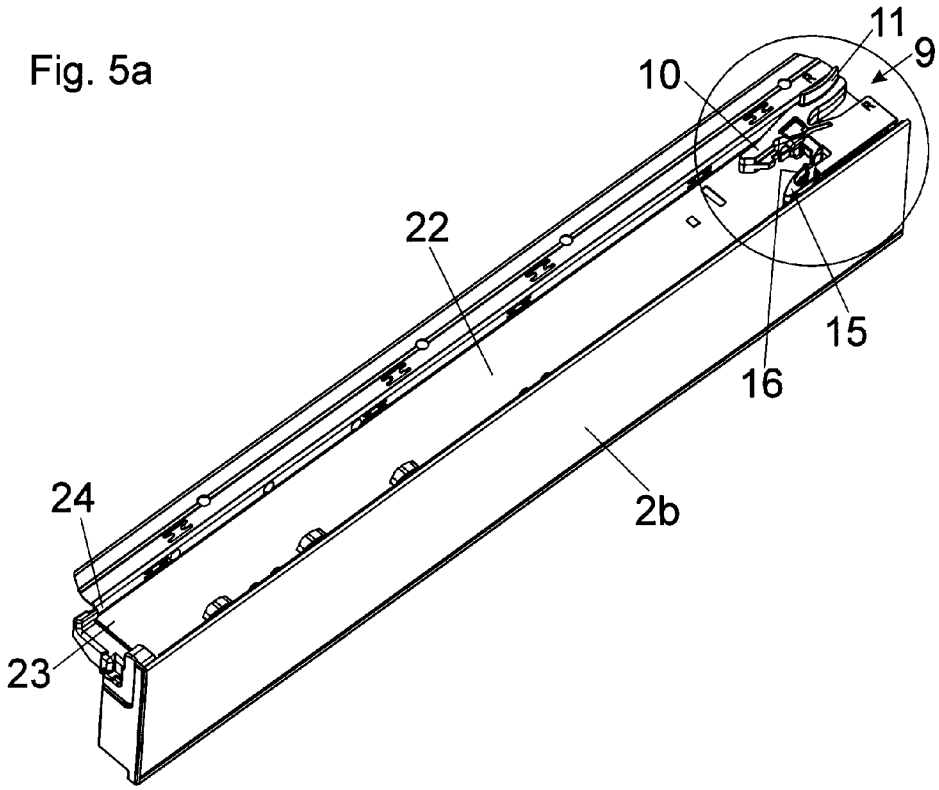
FIGS. 5*a* and 5*b* is a perspective view of the carrier rail from below with a coupling device mounted thereto and an enlarged detail view thereof.

FIG. 5*a* shows a perspective view from below of the drawer side wall 2*b*. The drawer side wall 2*b* is connected to the carrier rail 22, to which the drawer bottom 2*c* (not shown here) is to be fixed. The carrier rail 22 has a U-shaped profile, and the coupling device 9 is fixed at the front end of the carrier rail 22 within that U-shaped profile of the carrier rail 22. The fixing dowels 18 are used for fixing the coupling device 9 (FIG. 3*b*), and those fixing dowels 18 are anchored to the horizontal leg 23 of the carrier rail 22. The coupling device 9 can therefore be comfortably inserted from above into the U-shaped profile of the carrier rail 22 and fixed to the horizontal leg 23.

Figure 5B:
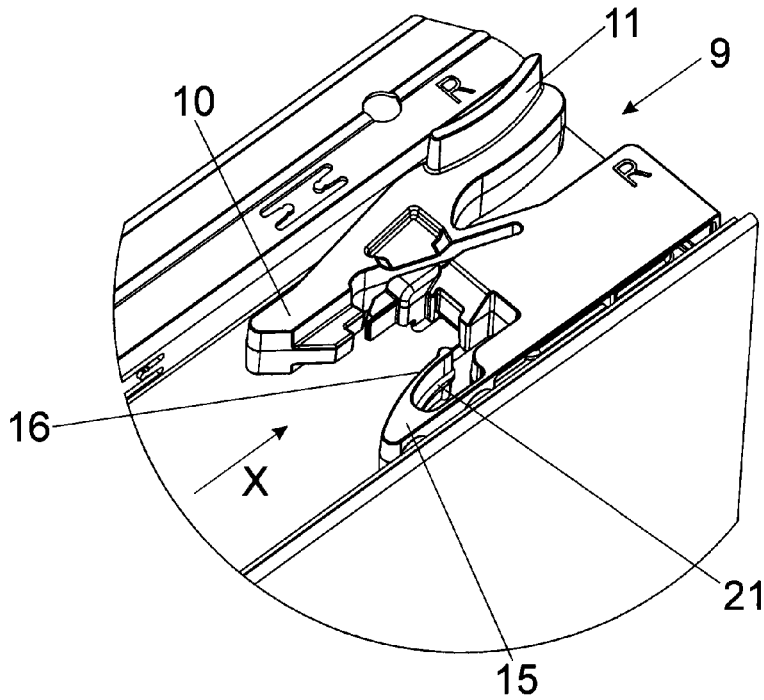

FIG. 5*b* shows an enlarged view of the region circled in FIG. 5*a*. The drawer 2 connected to the carrier rail 22 is thus pushed upon fitment of the drawer 2 onto the extendable rail 8, shown in FIG. 1, of the drawer extension guide 3. In this case, the rail 8 is guided within the U-shaped profile of the carrier rail 22, and the rail 8 can be introduced into the coupling device 9 in the direction of the illustrated arrow X and latched there.

Figure 6A:
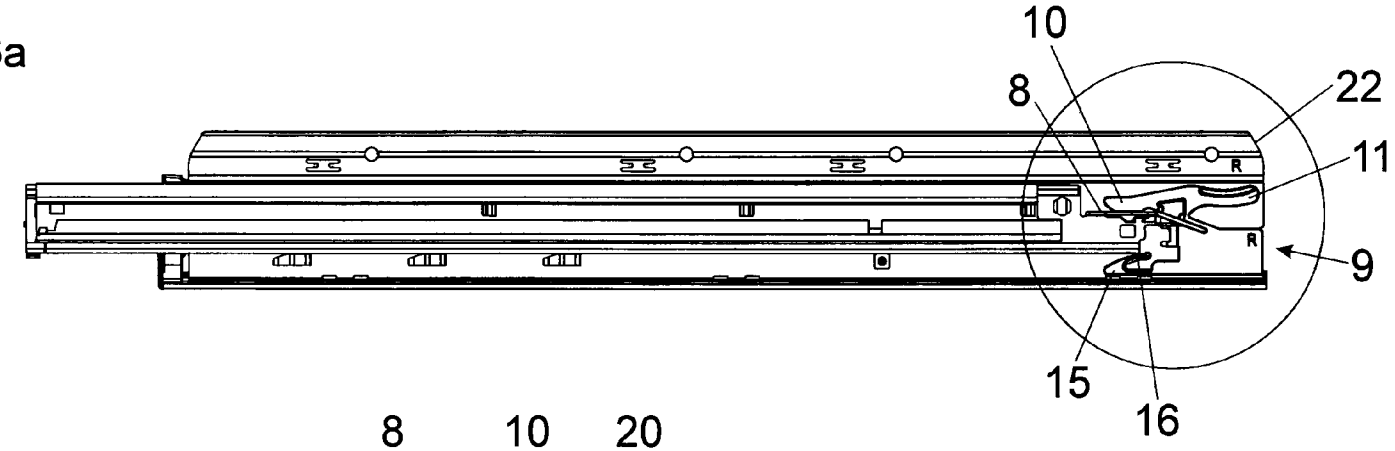
FIGS. 6*a* and 6*b* is a plan view of the carrier rail from below with an extension rail coupled thereto and an enlarged detail view thereof.
Figure 6B:
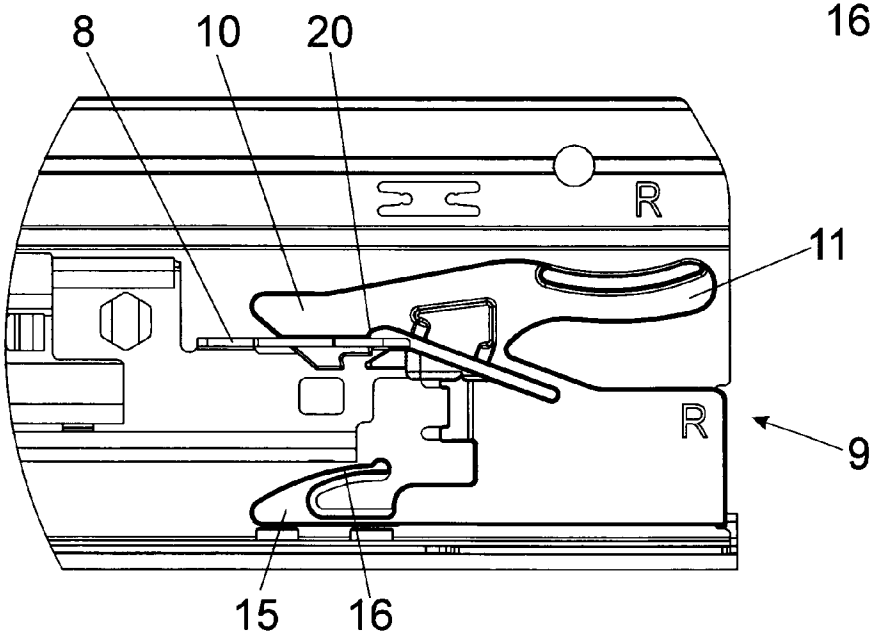

FIG. 6*a* shows a view from below of the carrier rail 22. Fixed at the front end of the carrier rail 22 is the coupling device 9 which is releasably coupled to a predetermined connecting location on the extendable rail 8 of the drawer extension guide 3. FIG. 6*b* shows an enlarged detail view of the region circled in FIG. 6*a*. The predetermined connecting location on the rail 8 can be formed by an opening arranged on the rail 8 or a latching edge on the rail 8, with which the abutment surface 20 of the latching portion 10 can engage. Both the latching portion 10 and also the spring tongue 16 of the counterpart holding portion 15 bear in that coupled position against the extendable rail 8. By applying manual pressure to the handle portion 11, the latching portion 10 is releasable relative to the extendable rail 8 whereby the drawer 2 in its entirety can be removed from the drawer extension guide 3.

Figure 7A:
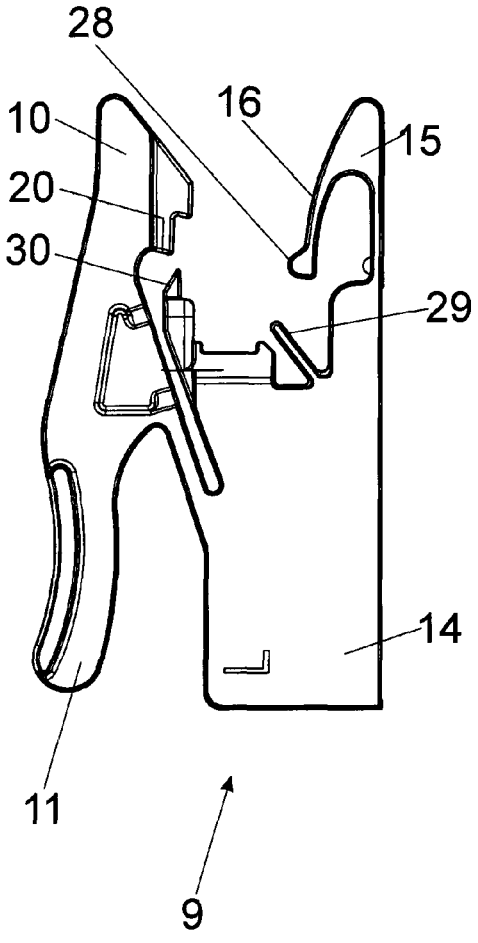
FIGS. 7*a* and 7*b* are views of two different coupling devices, wherein one coupling device can be arranged on a first side of the drawer and a second coupling device can be arranged on the other side of the drawer (left/right).
Figure 7B:
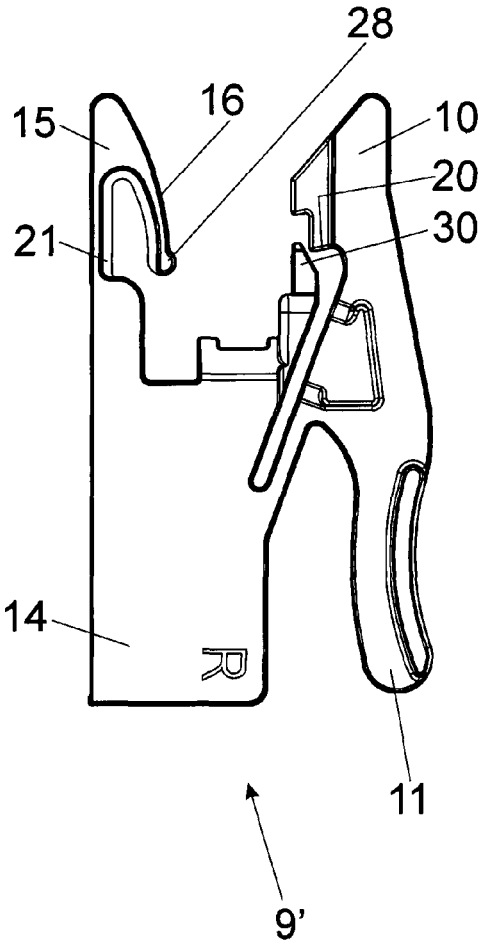

FIGS. 7*a* and 7*b* each show coupling devices 9, wherein the coupling device 9 shown in FIG. 7*a* can be arranged on the left-hand side of the drawer 2 and the coupling device 9' shown in FIG. 7*b* can be arranged on the right-hand side of the drawer 2. It can be seen from FIG. 7*b* that the spring tongue 16 is provided with a stiffening member 21 (for example, a stiffening rib) which limits the bendability of the spring tongue 16. It is possible in that way to provide for a differing degree of hardness of the spring tongues 16. That is advantageous in particular when the drawer 2 on the right-hand side (FIG. 7*b*) is to be substantially stably supported in the lateral direction so that the lateral play compensation is implemented almost exclusively on the left-hand side of the drawer (FIG. 7*a*). The device 9' in FIG. 7*b* has a carrier 30 which in the mounted position accommodates the front end of the extendable rail 8. In FIG. 7*b*, the carrier 30 projects to close to the abutment surface 20 in order to accommodate the extendable rail 8 in a substantially stable position on the right-hand side. In contrast, the spring tongue 16 does not have any stiffening member 21 on the left-hand side of the drawer 2 (FIG. 7*a*), and so that spring tongue is softer than the spring tongue 16 shown in FIG. 7*b* and thus can permit the desired lateral play compensation effect. The carrier 30 at the left (FIG. 7*a*) for that purpose is at a greater relative spacing from the abutment surface 20 in order to compensate for lateral play between the coupling device 9 and the rail 8. Connected to the spring tongue 16 is an abutment 28 which in the mounted position bears against the outside of the rail 8 and which is larger at the left in FIG. 7*a* than in FIG. 7*b*. Due to the softer nature of the spring tongue 16 in FIG. 7*a* it can also be deformed more greatly than that shown in FIG. 7*b*, and the arrangement of a laterally enlarged abutment 28 also makes it possible to compensate for larger lateral tolerances. As shown in FIG. 7*a*, the coupling device 9 can also have a further tongue 29 which in the mounted position bears against the front end of the rail 8. Any longitudinal play which may occur in respect of the coupling device 9 in relation to the rail 8 can be compensated for by the further tongue 29 in the latched position as between the coupling device 9 and the rail 8. The tongue 29 is adapted to be bendable in the longitudinal direction of the rail 8.

The longitudinal extent of the handle portion 11 extends in the mounted position approximately parallel to the longitudinal extent of the rail 8, and the free end of the handle portion 11 and the free end of the main body 14 are substantially at the same height. That enables a compact structure for the device 9 and easily accessible actuation of the handle portion 11. In a possible embodiment, the coupling device 9 can have an at least two-part configuration, wherein a first leg formed in one piece—comprising the counterpart holding portion 15 and the main body 14—is pre-stressed by way of a coil spring to a one-piece second leg—comprising the latching portion 10 and the handle portion 11. The coil spring serves in that case also as a joint so that it is possible to dispense with the arrangement of a flexural joint 13 (FIG. 3*a*).

The present invention is not limited to the illustrated embodiment but embraces or extends to all technical equivalents which can fall within the scope of the following claims. The positional details adopted in the description such as for example up, down, lateral, left, right and so forth are also related to the directly described and illustrated Figure and are to be appropriately transferred to the new position upon a change in position.

The invention claimed is:

1. A coupling device for releasably coupling a drawer to an extendable rail of a drawer extension guide, said coupling device comprising:

a latching portion configured to be releasably arrested for releasably coupling the drawer to the extendable rail of the drawer extension guide;

a hand-actuated handle portion for releasing said latching portion relative to the extendable rail of the drawer extension guide; and a counterpart holding portion having a spring tongue, said latching portion and said counterpart holding portion being arranged and configured for receiving and accommodating the rail between said counterpart holding portion and said latching portion in a mounted position;

wherein said latching portion is movable in a direction facing away from said counterpart holding portion by hand pressure applied on said handle portion; and wherein said spring tongue has a curved run-in incline for pressing the rail against the latching portion upon insertion of the rail into said coupling device.

2. The coupling device according to claim 1, wherein said spring tongue and said latching portion are resilient in a direction extending transversely relative to a longitudinal direction of the rail.

3. The coupling device according to claim 1, wherein said spring tongue has a stiffening member.

4. The coupling device according to claim 1, wherein a free end of said handle portion is located at an end of said coupling device opposite to said latching portion.

5. The coupling device according to claim 1, wherein said latching portion has a catch portion, said catch portion being configured to releasably arrest said coupling device to the rail in a first depth position.

6. The coupling device according to claim 5, wherein said latching portion has an abutment surface, said abutment surface being configured to releasably arrest said coupling device to the rail in a second depth position different from the first depth position.

7. The coupling device according to claim 6, wherein said latching portion is configured so that said catch portion and said abutment surface engage the same opening in the rail in the first depth position and in the second depth position, respectively.

8. The coupling device according to claim 1, wherein said coupling device is formed of plastic material and has a one-piece construction.

9. A drawer extension guide comprising:

a carcass rail to be fixed to a furniture carcass;

an extendable rail configured to be extendable relative to said carcass rail; and said coupling device according to claim 1 for releasably connecting a drawer to said extendable rail.

10. A furniture item comprising:

a drawer; and said drawer extension guide according to claim 9 releasably connected to said drawer.

11. The furniture item according to claim 10, further comprising a carrier rail mounted to said drawer, said carrier rail configured to be releasably coupled to said extendable rail by said coupling device.

12. A coupling device for releasably coupling a drawer to an extendable rail of a drawer extension guide, said coupling device comprising:

a latching portion configured to be releasably arrested for releasably coupling the drawer to the extendable rail of the drawer extension guide;

a hand-actuated handle portion for releasing said latching portion relative to the extendable rail of the drawer extension guide;

a counterpart holding portion having a spring tongue, said latching portion and said counterpart holding portion being arranged and configured for receiving and accommodating the rail between said counterpart holding portion and said latching portion in a mounted position; and a second tongue configured to bear against a front end of the rail in the mounted position so as to compensate for any longitudinal play between said coupling device and the rail in a latched position between said coupling device and the rail;

wherein said latching portion is movable in a direction facing away from said counterpart holding portion by hand pressure applied on said handle portion.

13. The coupling device according to claim 12, wherein said spring tongue and said latching portion are resilient in a direction extending transversely relative to a longitudinal direction of the rail.

14. The coupling device according to claim 12, wherein said spring tongue has a stiffening member.

15. The coupling device according to claim 12, wherein a free end of said handle portion is located at an end of said coupling device opposite to said latching portion.

16. The coupling device according to claim 12, wherein said latching portion has a catch portion, said catch portion being configured to releasably arrest said coupling device to the rail in a first depth position.

17. The coupling device according to claim 16, wherein said latching portion has an abutment surface, said abutment surface being configured to releasably arrest said coupling device to the rail in a second depth position different from the first depth position.

18. A coupling device for releasably coupling a drawer to an extendable rail of a drawer extension guide, said coupling device comprising:

a latching portion configured to be releasably arrested for releasably coupling the drawer to the extendable rail of the drawer extension guide;

a hand-actuated handle portion for releasing said latching portion relative to the extendable rail of the drawer extension guide;

a counterpart holding portion having a spring tongue, said latching portion and said counterpart holding portion being arranged and configured for receiving and accommodating the rail between said counterpart holding portion and said latching portion in a mounted position; and an injection-molded fixing dowel configured to fix said coupling device to a carrier rail to be mounted to the drawer;

wherein said latching portion is movable in a direction facing away from said counterpart holding portion by hand pressure applied on said handle portion.

19. A furniture item comprising:

a drawer;

a pair of drawer extension guides releasably connected to said drawer, each of said pair of drawer extension guides including:

a carcass rail to be fixed to a furniture carcass;

an extendable rail extendable relative to said carcass rail; and a pair of coupling devices for releasably coupling said drawer to said pair of drawer extension guides, each of said pair of coupling devices being located at a respective one of opposite sides of said drawer, each of said pair of coupling device including:

a latching portion configured to be releasably arrested for releasably coupling the drawer to the extendable rail of the drawer extension guide;

a hand-actuated handle portion for releasing said latching portion relative to the extendable rail of the drawer extension guide; and a counterpart holding portion having a spring tongue, said latching portion and said counterpart holding portion being arranged and configured for receiving and accommodating the rail between said counterpart holding portion and said latching portion in a mounted position;

wherein said latching portion is movable in a direction facing away from said counterpart holding portion by hand pressure applied on said handle portion; and wherein said spring tongue of a first one of said pair of coupling devices has a stiffening member so as to be stiffer than said spring tongue of a second one of said pair of coupling devices.

20. A coupling device for releasably coupling a drawer to an extendable rail of a drawer extension guide, said coupling device comprising:

a latching portion configured to be releasably arrested for releasably coupling the drawer to the extendable rail of the drawer extension guide;

a hand-actuated handle portion for releasing said latching portion relative to the extendable rail of the drawer extension guide; and a counterpart holding portion having a spring tongue, said latching portion and said counterpart holding portion being arranged and configured for receiving and accommodating the rail between said counterpart holding portion and said latching portion in a mounted position;

wherein said latching portion is movable in a direction facing away from said counterpart holding portion by hand pressure applied on said handle portion; and wherein said spring tongue and said latching portion are configured so as to oppose each other and form an introduction funnel for receiving a front end of the rail, a width of said introduction funnel decreasing in a direction toward a front panel of the drawer.

* * * * *